US005765723A

United States Patent [19]

Wilcox

[11] Patent Number: 5,765,723

[45] Date of Patent: Jun. 16, 1998

[54] BAG EVACUATOR

[75] Inventor: Donald E. Wilcox, Rochester, N.Y.

[73] Assignee: A. R. Arena Products, Inc., Rochester, N.Y.

[21] Appl. No.: 689,207

[22] Filed: Aug. 5, 1996

[51] Int. Cl.[6] ..... B65D 35/28

[52] U.S. Cl. ..... 222/1; 222/99; 222/100

[58] Field of Search ..... 222/1, 98, 99, 222/100, 105, 107

[56] References Cited

U.S. PATENT DOCUMENTS

| | | | |
|---|---|---|---|
| 2,625,096 | 1/1953 | Peterson | 222/100 X |
| 2,858,051 | 10/1958 | Cunningham . | |
| 3,095,206 | 6/1963 | Fresia et al. | 222/99 X |
| 3,138,292 | 6/1964 | Hanna | 222/99 |
| 3,430,815 | 3/1969 | Weimer et al. | 222/99 |
| 3,926,341 | 12/1975 | Lhoest | 222/105 |
| 4,161,263 | 7/1979 | Wagner | 222/100 |
| 4,167,235 | 9/1979 | Green | 222/105 |
| 4,182,464 | 1/1980 | Orrey | 222/98 |
| 4,327,844 | 5/1982 | Gratschew | 222/100 |
| 4,527,716 | 7/1985 | Haas et al. | 222/105 X |
| 4,541,765 | 9/1985 | Moore | 222/105 X |
| 4,718,577 | 1/1988 | Morris et al. | 222/105 |
| 4,722,655 | 2/1988 | Bonerb . | |
| 4,883,201 | 11/1989 | Poulton | 222/105 |
| 4,966,310 | 10/1990 | Hawkins | 222/105 |
| 4,998,991 | 3/1991 | Poulton | 222/181 |
| 5,118,011 | 6/1992 | Kopp | 222/105 |
| 5,176,299 | 1/1993 | Krooss . | |
| 5,320,251 | 6/1994 | Ellis | 222/105 |
| 5,333,757 | 8/1994 | Volk et al. | 222/105 |
| 5,377,876 | 1/1995 | Smernoff | 222/105 |

*Primary Examiner*—Kenneth Bomberg
*Attorney, Agent, or Firm*—Eugene Stephens & Associates

[57] ABSTRACT

An evacuator for a plastic bag containing viscous liquid within a rectangular, parallelepiped container having a drain positioned at a bottom edge region uses a windlass for drawing and winding an evacuated upper region of the bag to a region above the drain. A bag wall region diagonally opposite the drain is gripped, preferably with a noose; and a windlass positioned on the walls of the container above the drain draws the gripped region of the bag across the top of the container and then winds the evacuated upper regions of the bag onto the windlass to funnel the viscous liquid toward the drain in lower, unevacuated regions of the bag.

29 Claims, 3 Drawing Sheets

BAG EVACUATOR

TECHNICAL FIELD

Removal of viscous liquid contents from a plastic bag arranged within a container having a rectangular, parallelepiped shape.

BACKGROUND

Plastic bags containing viscous liquids within generally rectangular, parallelepiped containers have many advantages. The containers are compact and reusable and provide the necessary strength for shipping liquid materials, and the plastic bags confine the liquids successfully and inexpensively within the containers. After a liquid shipment is delivered, the liquid is drained from the bag via a drain arranged at a bottom edge region of the container, whereupon the bag can be discarded or recycled and the container can be collapsed and reused for another shipment.

When viscous liquids are packaged and shipped this way, draining all the liquid from the bag within the container becomes difficult. The liquid can be pumped from the drain during evacuation of most of the liquid contents, but straightforward pumping cannot be relied upon to dispense the last few gallons from the bag. The bottom of the container is flat, and viscous liquid may not flow readily across the bottom of the container to the drain. The bag collapses as the liquid is evacuated, and the bag wall sometimes clogs the drain. Many expedients have attempted to solve these problems so as not to waste unevacuated liquid. So far, none of the attempts have solved the problems satisfactorily.

SUMMARY OF THE INVENTION

My solution involves keeping the drain flooded with unevacuated viscous liquid so that a pump drawing the liquid from the drain can evacuate substantially all of the liquid. I accomplish this by applying a removable gripper to an evacuated upper wall region of the bag diagonally opposite the drain and pulling and lifting on the gripper to draw the gripped region of the bag across the top of the container to a region above the drain, while lifting the gripped region of the bag. By continually applying lifting force to evacuated portions of the bag wall above the drain, the unevacuated wall portions of the bag are maneuvered to funnel the viscous liquid toward the drain.

For accomplishing the pulling and lifting, I prefer a windlass mounted on an upper wall region of the container above the drain. A strap or other tension device combined with the bag gripper then winds onto the windlass to draw the gripped region of the bag across the upper region of the container. As winding continues, the gripped region of the bag is wound onto the windlass. By advancing the winding of the windlass during bag evacuation, the evacuated portions of the bag wall can be lifted up to the windlass so that the drain is kept flooded with viscous liquid. The necessary apparatus for accomplishing this is simple and inexpensive, and the drawing and lifting of the gripped region of the bag can be semiautomated. The result greatly reduces the waste of unevacuated viscous liquid.

DRAWINGS

DETAILED DESCRIPTION

Figure 1:
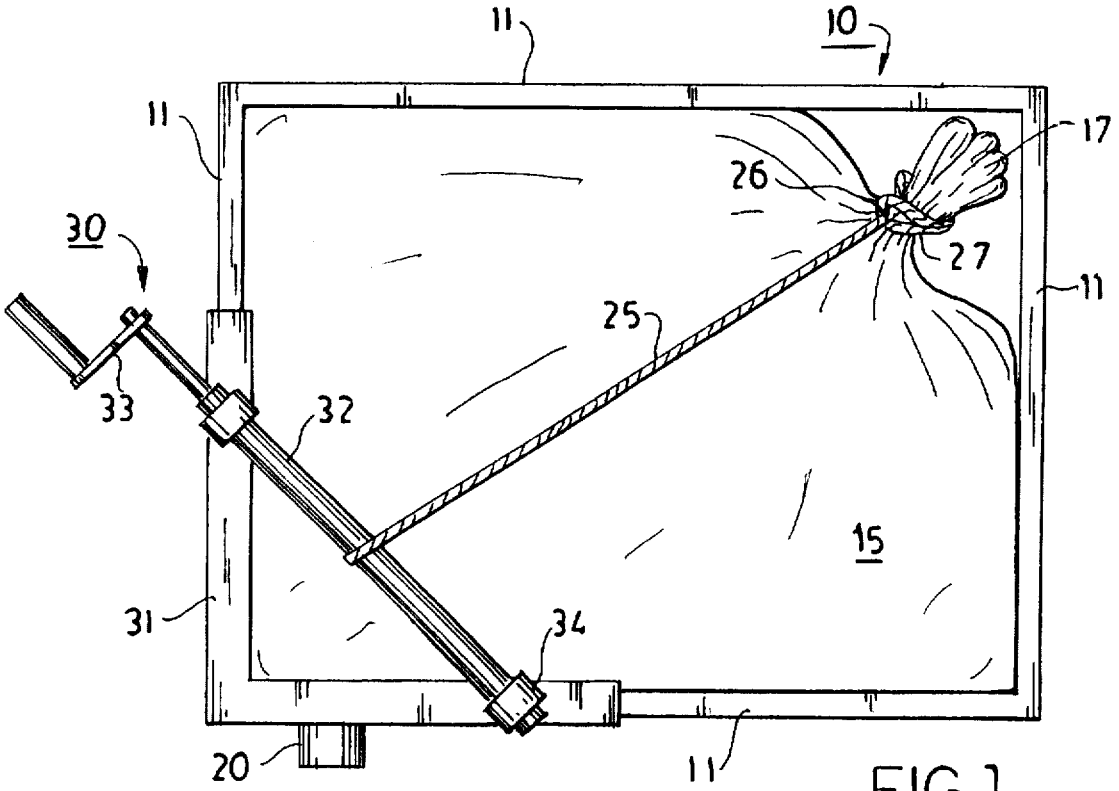
FIG. 1 is a partially schematic plan view of a preferred embodiment of my bag evacuator gripping an evacuated region of a bag wall.

My bag evacuator applies to a plastic bag 15 arranged within a container 10 having a generally rectangular, parallelepiped shape. Container 10 can be formed of resin material with side walls 11 that fold inward and downward over a base 12 to reduce the container size for return shipment. Container 10 is illustrated only schematically in the drawings, because its configuration is well known in the art of shipping liquid materials.

The generally rectangular, parallelepiped shape of container 10 facilitates liquid shipment, because containers 10 can be arranged side by side on a truck and can be stacked on top of each other to make maximum use of available truck bed space. The dimensions of container 10 can vary, generally between sizes larger than 55 gallon drums and smaller than tank trucks or tank cars. The dimensions of container 10 are also generally limited to sizes that can be handled with fork lift trucks so that container capacity generally ranges between 100 and 700 gallons. One preferred size for container 10 holds about 330 gallons and is nearly a cube slightly less than 4 feet square.

Container 10 has a drain 20 positioned along a lower edge region at the level of the container bottom. Side edge drains are preferred to bottom center drains for containers 10 so that the container need not be elevated for draining the liquid contents. Drain 20, as illustrated in FIGS. 1–6, is arranged near a corner of container 10.

Bag 15 has a bag drain 16 that connects with container drain 20 when bag 15 is arranged within container 10. The drain is closed, of course, until the contents of bag 15 are to be evacuated. Then a pump (not shown) is connected to drain 20, which is opened so that a pump can withdraw liquid.

In the early stages of draining liquid from bag 15 within container 10, nothing need be done other than allow a pump to draw liquid from drain 20. If the liquid material in bag 15 is especially viscous, though, it will flow slowly toward drain 20 and will not be fully evacuated simply by pumping out of drain 20. The viscous materials that can benefit from my evacuator have a viscosity of at least 1000 centipoise and may have viscosities ranging up to 250,000 centipoise. If the materials are both highly viscous and highly valuable, full evacuation from bag 15 is especially important, and also difficult. Examples of liquids having viscosities that benefit from my bag evacuator are tomato paste and mayonnaise.

After a portion of the viscous liquid contents of bag 15 is pumped through drain 20 and upper wall regions of bag 15 have collapsed somewhat, gripper 25 is attached to bag wall 17. This can be done in several ways, and my preference is to use a gripper 25 that has an end noose 26 so that a gathered-together region of evacuated bag wall 17 can be encircled with noose 26 in a slip knot fashion that affords a secure grip. A noose-ended sling made of a fiber resin material can be used for gripper 25; and to improve the friction of the grip on gathered-up bag wall region 17, I prefer applying a friction coating 27 to noose 26. This can be a resinous material of the form applied to the handles of tools such as pliers. Gripper 25 is then positioned for pulling on and lifting the gripped region 17 of bag 15. Alternatives for gripper 25 include various clamps, tape, and different tension devices such as cords and cables. It is also possible to construct bag 15 with a properly located attachment for connection to a bag gripper.

The bag region 17 that is gripped by puller 25 is diametrically opposite drain 20. Since drain 20 is on a bottom edge of container 10, the gripped bag region 17 is on an evacuated upper wall region of bag 15. Also, with drain 20 positioned near a corner of container 10, as shown in FIGS. 1–6, gripped bag region 17 is preferably in a diametrically opposite corner of container 10.

After bag region 17 is gripped, it is pulled across container 10 to a region directly above drain 20. This can be accomplished in several ways, and the device I prefer for this is the windlass 30 schematically illustrated in FIGS. 1 and 2. Rather than have a separate support for windlass 30, I prefer mounting windlass 30 on an upper region of walls 11 of container 10. When container drain 20 is arranged near a bottom corner region of container 10, as shown in FIGS. 1–6, windlass 30 is arranged above the drain corner of container 10. A simple frame 31 can rest on top of container walls 11 and support windlass 30 as schematically illustrated.

Puller 25 is connected to a winding shaft or mandrel 32 of windlass 30, and a hand crank 33 is arranged for turning mandrel 32. The pulling and lifting force applied by connector 25 to gripped bag wall region 17 is estimated at about 150 pounds. To support this load, I prefer that windlass shaft 32 be formed of a stainless steel tube about 1.5 inches in diameter.

The advance of windlass 30 is preferably held by a ratchet 34 so that torque applied to winding shaft 32 by hand crank 33 maintains a pulling and lifting tension on bag 15. In effect, this allows pulling and lifting force on gripped bag region 17 to be applied and held during bag evacuation. After the bag is evacuated, ratchet 34 can be reversed by moving switch 35 so that windlass 30 can be unwound.

The winding of windlass 30 first draws the gripped bag region 17 across container 10 toward the windlass location above drain 20. This tends to draw toward the drain the evacuated regions of the bag farthest from the drain. The drawing of the gripped bag region 17 toward windlass 30 is illustrated in an early stage in FIG. 3 and in a more advanced stage in FIG. 4.

Figure 5:
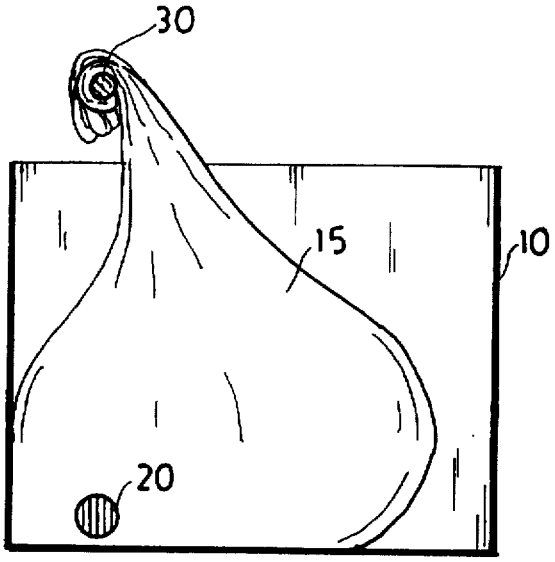
Figure 6:
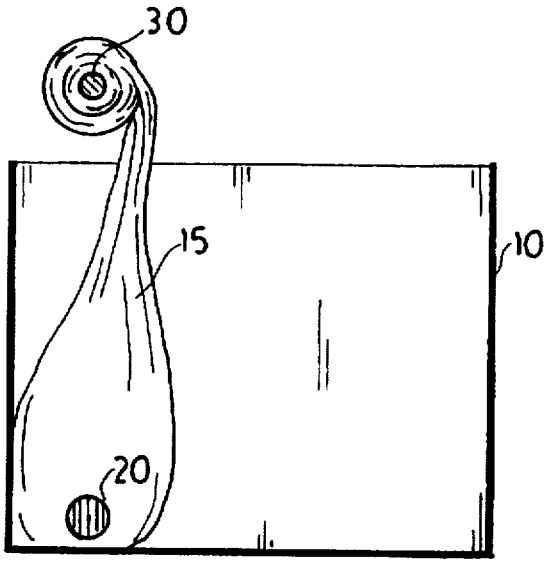

As winding continues further, the gripped bag region is wound onto windlass 30, which gathers evacuated bag regions above drain 20 and pulls unevacuated bag regions toward drain 20. This stage is illustrated in FIG. 5. When evacuation is nearly complete, bag winding has advanced to the stage illustrated in FIG. 6 where several turns of evacuated bag are wound onto windlass 30 and unevacuated bag regions closely surround drain 20. This process maneuvers the wall of bag 15 so that unevacuated regions are funneled toward drain 20, and also floods drain 20 with liquid material to ensure that no evacuated bag wall can reach to and interfere with drain 20. The bag lifting and funneling process also moves the viscous liquid material more effectively toward drain 20 so that a pump drawing the material from drain 20 can continue operating. The drawing and lifting of evacuated regions of bag 15 thus funnel the viscous liquid toward drain 20 and keep the drain flooded so that substantially all the bag contents can be removed by the drain pump.

Pulling and lifting the gripped region 17 of bag 15 need not be accomplished by a windlass. Cranes, hoists, and arrangements of pulleys and ropes are also possible. A ratchet winch with a longer connector 25 can be substituted for windlass 30.

Figure 7:
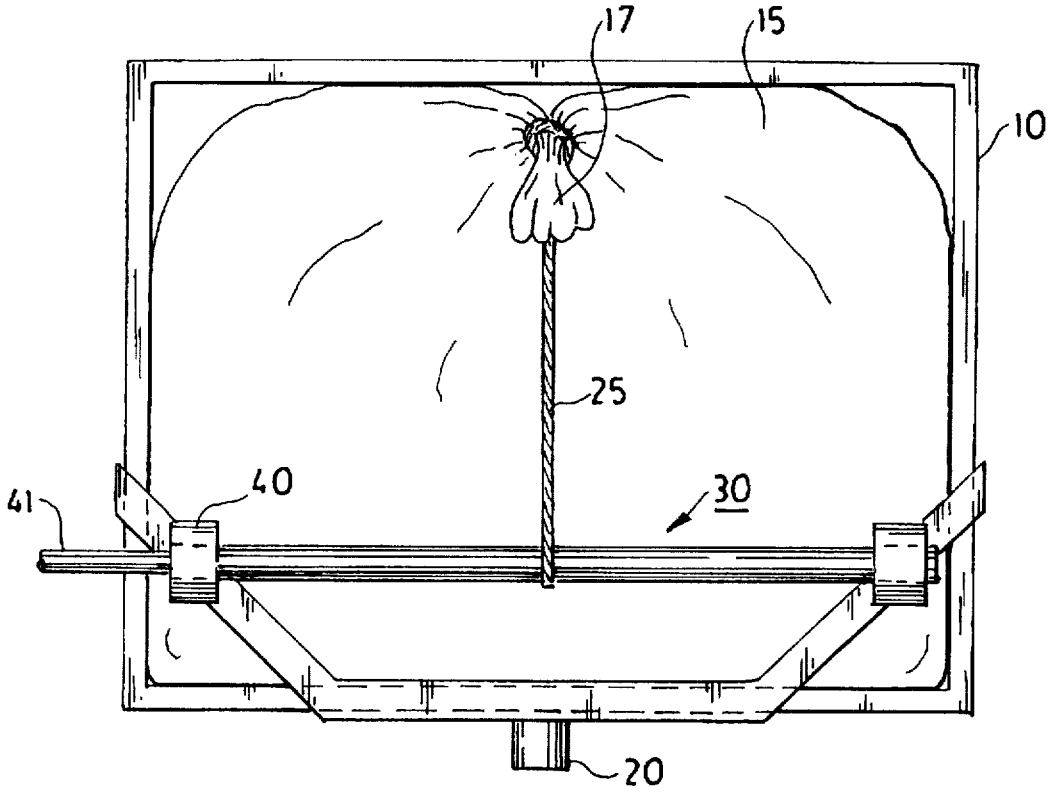
FIG. 7 is a partially schematic plan view of an alternative preferred embodiment of my bag evacuator.

Drain 20 need not be in a corner region of container 10, as illustrated in FIGS. 1–6, but can be in a center of a bottom edge region of contain 10, as schematically shown in FIG. 7. Windlass 30 is then arranged in a central upper region of a wall of container 10 so that a gripped bag region 17 diagonally opposite drain 20 can be drawn and lifted to a region directly above drain 20.

Figure 2:
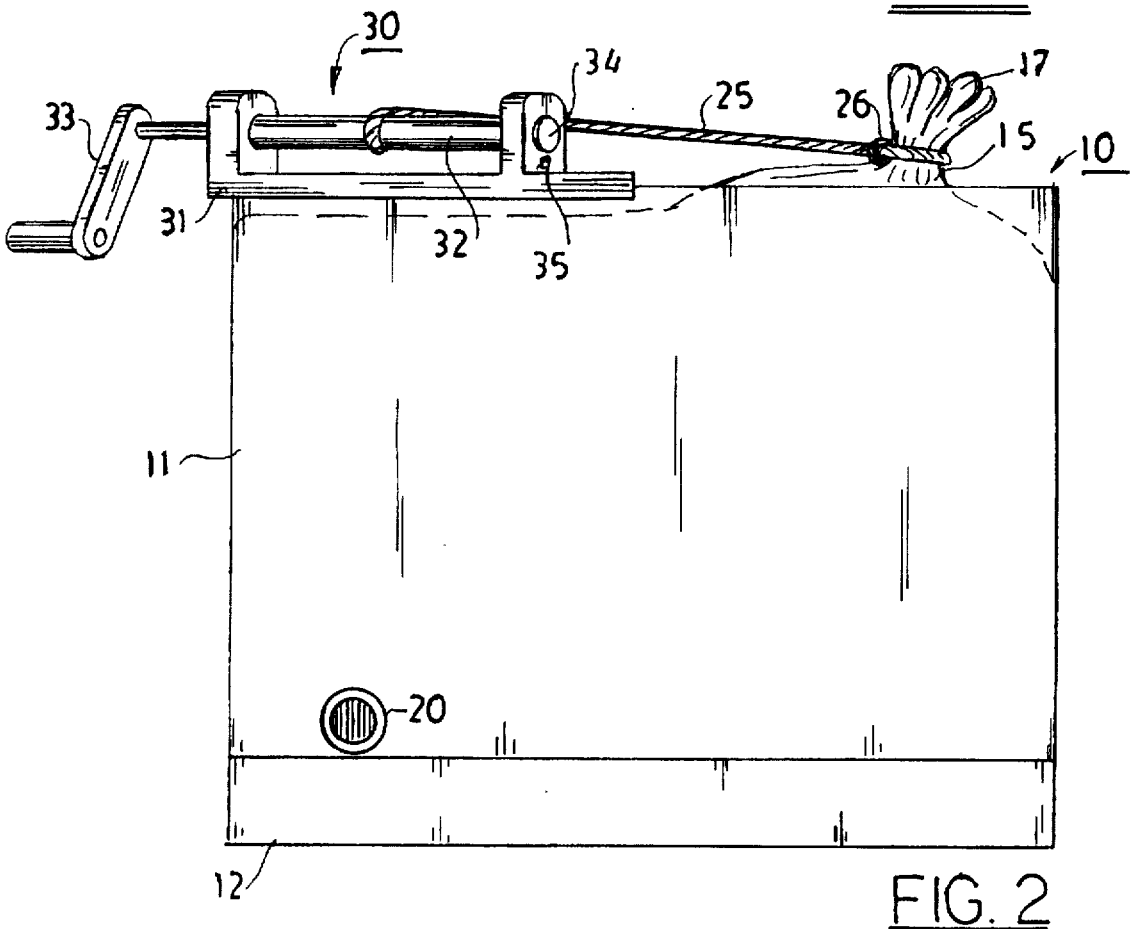
FIG. 2 is a partially schematic, side elevational view of the bag evacuator of FIG. 1.
Figure 3:
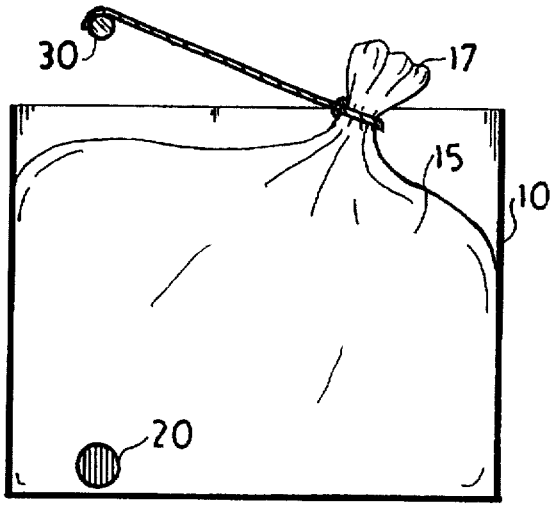
FIGS. 3–6 are schematic side views of successive stages of pulling and lifting a gripped region of a bag for evacuating the bag contents.
Figure 4:
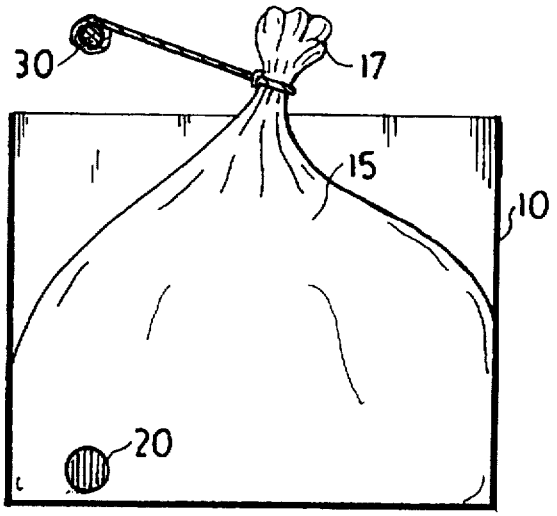

Windlass 30 of FIG. 7 illustrates a pneumatic drive 40 powered by a pneumatic line 41, instead of the hand crank 33 shown in FIGS. 1 and 2. Air drive 40 is preferably a pneumatic ratchet that can apply and hold winding torque, and a air drive is preferred for its ability to stall. Drive 40 then can apply a predetermined winding torque to windlass 30 for continually drawing and lifting on gripped bag wall region 17 without applying excessive force. If bag 15 offers too much resistance, drive 40 will simply stall. This can make the bag drawing and winding semiautomatic, whereas bag evacuation by means of the windlass illustrated in FIGS. 1 and 2 requires an operator to wind the windlass a few turns periodically. Once bag wall 17 is gripped and winding torque is applied to connector 25 by air drive 40, an operator need not periodically attend to the further evacuation of bag 15. Like the ratchet drive 34 of the hand crank windlass, air ratchet drive 40 is reversible for unwinding the bag from windlass 30 after it is evacuated.

Figure 8:
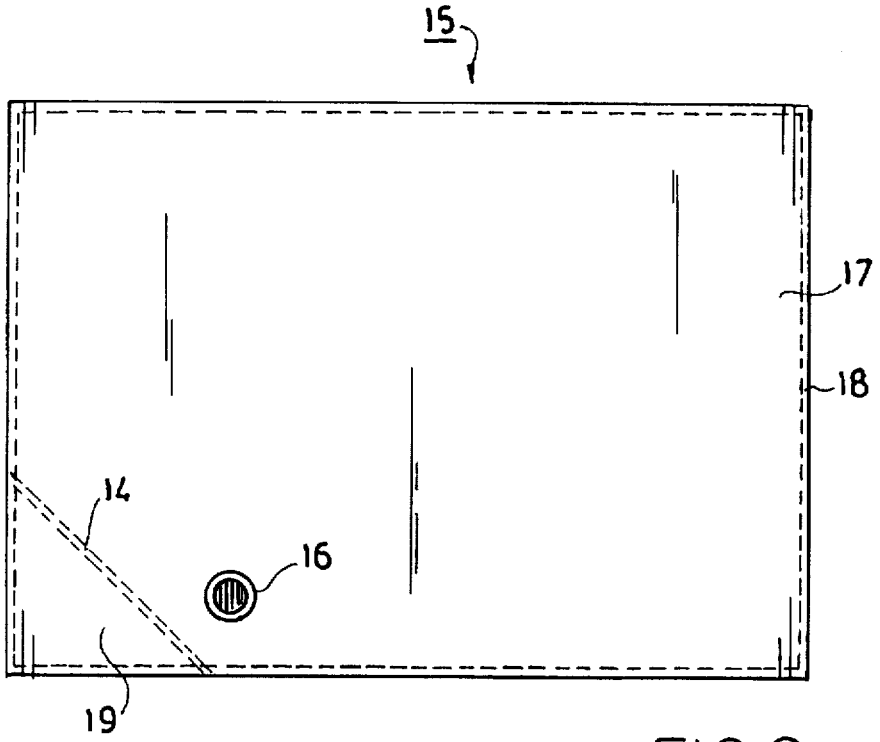
FIG. 8 is a plan view of a pillow bag having a corner seam cooperating with my bag evacuator.

A preferred form of bag 15 for container 10 is a pillow bag, such as shown in FIG. 8. Bag 15 is preferably formed of multilayered walls that are joined in a peripheral seam 18 similar to a pillow. If bag 15 were inflated, it would grow to a pillow shape.

Since a pillow shape does not precisely fit the rectangular, parallelepiped shape of container 10, bag 15 is made with excess material that can be folded on itself within container 10. Bag 15 is large enough so that when filled with liquid material, it can expand into contact with the full interior surfaces of walls 11 of container 10, while some excess folds occur in the walls of bag 15. Bags can also be made in generally rectangular, parallelepiped shapes that have a more tailored fit within container 10, but pillow bags 15 are often preferred for economy.

Bag drain 16 is spaced inward from a corner region of pillow bag 15 to a position where it can connect with container drain 20 when bag 15 is arranged within container 10. The pillow shape of bag 15 requires this, because the 4 corners of bag 15 do not coincide directly with the 8 corners of container 10.

I have found that the bag corner 19 nearest to bag drain 16 provides an undesirable space for viscous liquid material to lodge as bag 15 is pulled and lifted during evacuation. Bag corner 19 provides excess material necessary to fit the pillow shape of bag 15 into the rectangular, parallelepiped shape of container 10; but to avoid escape of liquid into bag corner 19 during bag evacuation, I prefer a corner seam 14 that seals off corner 19 from any liquid flow. Corner seam 14 preferably extends diagonally across corner 19 and is arranged proximate to bag drain 16 and between bag drain 16 and corner 19. The presence of corner seam 14 saves liquid material that might otherwise be wasted during bag evacuation, because any liquid finding its way into corner 19 cannot be lifted and funneled toward bag drain 16 by lifting evacuated bag regions.

The preferred embodiments of my bag evacuator inexpensively and satisfactorily accomplish nearly complete evacuation of viscous liquid material from bag 15. The labor involved is minor, and even this can be reduced by using a windlass driven by an air ratchet.

I claim:

1. An evacuator combined with a plastic bag containing viscous liquid within a rectangular, parallelepiped container so that a drain from the bag is positioned at a bottom edge region of the container, the evacuator comprising:

a. a connector that removably grips an upper region of a wall of the bag diagonally opposite the drain;

b. the connector extending from the gripped upper region of the bag across the container to a windlass mounted on the container above the drain; and c. a drive for winding the connector onto the windlass and drawing the gripped region of the bag onto the windlass so that emptied upper regions of the bag are drawn to and wound on the windlass to funnel toward the drain the viscous liquid remaining in the bag.

2. The evacuator of claim 1 wherein the drain is in a corner region of the container, the windlass is positioned above the corner region, and the region of the bag gripped by the connector is an upper corner region of the bag diagonally opposite the drain.

3. The evacuator of claim 2 wherein the bag is a pillow bag that has a corner seam positioned to exclude the viscous liquid from flowing into a bag corner beyond the drain.

4. The evacuator of claim 1 wherein the connector has a noose for gripping the wall of the bag.

5. The evacuator of claim 4 wherein the noose has a friction coating for gripping the bag wall.

6. The evacuator of claim 1 wherein the drive for the windlass applies and holds a lifting force.

7. The evacuator of claim 6 wherein the drive is reversible for unwinding the bag from the windlass after evacuating the viscous liquid.

8. A method of evacuating viscous liquid contents of a plastic bag arranged within a rectangular, parallelepiped container so that the bag has a drain disposed in a bottom edge region of the container, the method comprising:

a. removably fastening a connector to a far upper edge region of the bag diagonally opposite the drain after a portion of the contents of the bag has been evacuated via the drain;

b. winding the connector on a windlass positioned above a near upper edge region of the container above the drain so as to draw the far upper edge region of the bag across the container toward the windlass; and c. applying winding force raising the far upper edge region of the bag to a region of the windlass and winding the bag onto the windlass to elevate evacuated regions of the bag above the drain so that the liquid contents of the bag flood the drain during evacuation.

9. The method of claim 8 including using lifting force insufficient to lift the entire bag above the drain.

10. The method of claim 8 including prepositioning the windlass on upper wall regions of the container.

11. The method of claim 8 including holding a lifting position of the windlass.

12. The method of claim 11 including reversing the windlass and unwinding the bag from the windlass.

13. The method of claim 8 including noosing the connector to a gathered-together wall region of the bag that is emptied of contents.

14. Apparatus for draining a viscous liquid from a plastic bag arranged within a container having a rectangular, parallelepiped shape, the bag providing a drain from a lower edge region of the container, the apparatus when combined with the bag and the container comprising:

a. a removable connector gripping an upper wall region of the bag diagonally opposite the drain;

b. the connector extending from the gripped upper wall region of the bag to a lifting device mounted above the container in a region above the drain; and c. a drive for the lifting device exerting and holding a lifting force applied to the connector and to the gripped region of the bag in a direction for drawing the gripped region of the bag toward the lifting device so that a lifted portion of the bag wall funnels the liquid toward the drain.

15. The apparatus of claim 14 wherein the drain is in a lower corner region of the container, and the gripped region of the bag is in an upper corner region of the bag diagonally opposite the drain.

16. The apparatus of claim 14 wherein the connector has a noose that removably grips the upper wall region of the bag.

17. The apparatus of claim 16 wherein the noose has a friction coating for gripping the bag wall.

18. The apparatus of claim 14 wherein the lifting device comprises a windlass for winding up the connector and the gripped region of the bag.

19. The apparatus of claim 18 wherein the drive is reversible for unwinding the bag from the windlass.

20. The apparatus of claim 18 wherein the windlass is mounted on an upper region of the container.

21. The apparatus of claim 14 wherein the bag is a pillow bag having a corner seam that excludes the viscous liquid from entering a bag corner proximate to the drain.

22. A method of evacuating a viscous liquid from a plastic bag arranged within a rectangular, parallelepiped container to provide a drain from a bottom edge region of the container, the method comprising:

a. evacuating a major portion of the liquid via the drain, and then gathering up and noosing an emptied upper region of a wall of the bag diagonally opposite the drain;

b. drawing the noosed region of the bag across the container to a region above the drain while lifting the noosed upper region of the bag sufficiently for funneling toward the drain the liquid remaining in the bag; and c. maintaining a lifting force on the noosed upper region of the bag sufficient for drawing evacuated regions of the bag wall toward the region above the drain until the liquid evacuates from the drain.

23. The method of claim 22 including using a windlass for drawing and lifting the noosed region of the bag.

24. The method of claim 23 including applying to the windlass a predetermined torque adequate to achieve the lifting force and insufficient to lift the bag and its contents from the container.

25. An evacuator combined with a plastic bag containing viscous liquid within a rectangular, parallelepiped container, said bag having a drain for evacuating the liquid from a bottom edge region of the container, the evacuator comprising:

a. a bag wall gripper removably attachable to an evacuated portion of a gripped upper wall of the bag in a region diagonally opposite the drain;

b. a lifting puller arranged above the container for pulling the bag gripper and the gripped upper wall region of the bag across an upper region of the container while lifting the gripper and the gripped upper wall of the bag to a position above the drain; and c. the lifting puller holding evacuated portions of the bag wall above the drain so that unevacuated wall portions of the bag funnel the viscous liquid toward the drain.

26. The evacuator of claim 25 wherein the drain is arranged in a lower corner region of the container, the lifting puller is arranged above on an upper corner region of the container above the drain, and the bag gripper grips an upper corner region of the bag diagonally opposite the lifting puller.

27. The evacuator of claim 25 wherein the lifting puller comprises a windlass for winding up the bag gripper and the gripped wall region of the bag.

28. The evacuator of claim 27 including a drive for applying torque to the windlass.

29. The evacuator of claim 25 wherein the bag is a pillow bag having a seam excluding the viscous liquid from a corner of the bag proximate to the drain.

* * * * *

UNITED STATES PATENT AND TRADEMARK OFFICE

CERTIFICATE OF CORRECTION

PATENT NO. : 5,765,723

DATED : June 16, 1998

INVENTOR(S) : Donald E. Wilcox

It is certified that error appears in the above-identified patent and that said Letters Patent is hereby corrected as shown below:

Claim 26, line 3, after arranged, delete "above".

Signed and Sealed this

Thirteenth Day of October 1998

*Attest:*

*Attesting Officer*

Bruce Lehman

BRUCE LEHMAN

*Commissioner of Patents and Trademarks*